United States Patent [19]

Limbach et al.

[11] Patent Number: 4,905,817

[45] Date of Patent: Mar. 6, 1990

[54] APPARATUS FOR SEPARATING ADJACENT MATERIAL FORMATS

[75] Inventors: Gerhard Limbach, Weisbaden; Wilfried Sonntag, Mainz, both of Fed. Rep. of Germany

[73] Assignee: Hoechst Aktiengesellschaft, Frankfurt am Main, Fed. Rep. of Germany

[21] Appl. No.: 277,681

[22] Filed: Nov. 28, 1988

[30] Foreign Application Priority Data

Nov. 28, 1987 [DE] Fed. Rep. of Germany ..... 3740450

[51] Int. Cl.[4] ..... B65G 47/26

[52] U.S. Cl. ..... 198/458; 198/624; 198/782

[58] Field of Search ..... 198/458, 624, 782, 786; 83/101, 107, 156; 225/99

[56] References Cited

U.S. PATENT DOCUMENTS

| | | | |
|---|---|---|---|
| 2,594,590 | 4/1952 | Runton | 198/782 |
| 2,801,727 | 8/1957 | Malnati | 198/458 |
| 3,401,785 | 9/1968 | Ferrari | 198/458 |
| 3,861,515 | 1/1975 | Runyan et al. | 198/624 |
| 4,331,273 | 5/1982 | Hyatt | 225/99 |

FOREIGN PATENT DOCUMENTS

| | | |
|---|---|---|
| 2007569 | 12/1971 | Fed. Rep. of Germany . |
| 2922362 | 11/1982 | Fed. Rep. of Germany . |

*Primary Examiner*—Joseph E. Valenza

*Attorney, Agent, or Firm*—Foley & Lardner, Schwartz, Jeffery, Schwaab, Mack, Blumenthal & Evans

[57] ABSTRACT

A roll frame which has two arched rolls, the radii of which can be adjusted by an adjustment crank. Adjacent material formats, such as printing plates or printed circuit boards, are separated parallel to each other transversely to the running direction by an individualizing interval when running through the feed nip between the two arched rolls. The individualizing interval is directly proportional to the format length and the format width of the printing plates or printed circuit boards, and indirectly proportional to the square root of the difference of the squares of the arched roll radius and half the format width.

15 Claims, 3 Drawing Sheets

APPARATUS FOR SEPARATING ADJACENT MATERIAL FORMATS

BACKGROUND OF THE INVENTION

The invention relates to an apparatus for separating adjacent material formats, having two arched rolls which are arranged one above the other as a pair of squeeze rolls, through the feed nip of which the material formats run.

Such an apparatus may, for example, be part of a stacking system for boards, in particular printing plates, printed circuit boards and similar material formats, in which the boards, which are directly adjacent for processing reasons, are guided for example in four lines.

For stacking of the four adjacent boards, it is necessary to separate them and deposit them between separating plates in order to prevent them from hooking on to one another during the depositing operation.

German Patent Specification No. 2,007,569 discloses a roll frame for the separating of webs running parallel and next to one another, having a feed deflection roll, a delivery deflection roll and two arched rolls in between, the planes of curvature of which are aligned parallel to each other and to the deflection rolls and around which the webs are guided with an S-shaped wraround. The webs run onto the arched roll which is positioned first in the direction of running in the region of the generating line of greatest concavity and leaving the second arched roll in the region of the generating line of greatest convexity. To alter the angle of wraround, and thus to separate the webs, the two arched rolls can be pivoted in the same direction about the center parallel of the deflection roll axes on swivel arms lying symmetrical to the center parallel. For this purpose, alignment arms, interacting with the pivoting of the swivel arms, are available as coupling elements for adjustment of the rotatable arched roll shaft such that the plane of curvature of the respective arched roll shaft is constantly aligned perpendicular to the plane which is determined by the arched roll shaft and the assigned deflection roll shaft. The webs, such as plastic webs, aluminum webs, adhesive tapes or the like, are produced from a wide web by longitudinal cutting to the necessary width. Before the winding-up of the individual webs, they must be separated in order to obtain a distance between neighboring webs so that neighboring individual windings on the winding shaft do not have contact with one another.

German Patent Specification No. 2,922,362 describes an apparatus for the spreading and guiding of a web running through, such as a web of film, woven fabric, non-woven fabric or of another fibrous material, having individual bearing elements for the web which can be drawn apart in the longitudinal direction of the roll, which elements are anchored at both ends on the circumference of control rings which are rotatable coaxially with the shaft and which are connected to a guide rod each and, in between, to a tie rod-like coupling element, for inclining with respect to the shaft. In this apparatus, a control and/or stabilization roll is assigned to the roll surface in the web running direction and is mounted rotatably on the coupling element of the guide rods. The stabilization roll has a roughened surface layer. This apparatus is not intended for the separation of a plurality of material webs.

The foregoing illustrates limitations known to exist in present devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

The object of the invention is to further develop an apparatus of the type described above for separating material formats adjacent to each other in the running direction, such as printing plates, printed circuit boards, film formats, sheets and the like in such a way that the material formats can be brought into constant individualizing intervals in a transverse direction to the running direction and that the individualizing intervals are independent of given format dimensions, while maintaining the parallelism of the transversely individualized boards.

In one aspect of the present invention, this is accomplished by providing an apparatus for separating adjacent material formats comprising a pair of arched rolls each having a roll radius and being arranged one above the other as a pair of squeeze rolls having a nip therebetween. The formats run in a running direction through the nip of the rolls. Means are provided for adjusting the radii of the rolls for achieving an interval (2t) between the formats transverse to the running direction of the formats.

For this purpose, each of the arched rolls is preferably mounted freely movably in the axial direction, with the one arched roll shaft end being mounted in a sliding bearing bushing in a bearing block. The other roll end of each arched roll is preferably mounted immovably in the axial direction in a bearing block.

In further preferred embodiment of the invention, each of the arched roll shaft ends is mounted in one of the bearing blocks, which has on two sides diametrically opposed pintles and is rotatable about these pintles. These pintles are mounted in sliding bearing bushings perpendicularly to the axial direction in bearing receptacles of upright plates.

The foregoing and other aspects will become apparent from the following detailed description of the invention when considered in conjunction with the accompanying drawing figures. It is to be expressly understood, however, that the drawing figures are not intended as a definition of the invention but are for the purpose of illustration only.

BRIEF DESCRIPTION OF THE DRAWING FIGURES

DETAILED DESCRIPTION OF THE PREFERRED EMBODIMENTS

Figure 1:
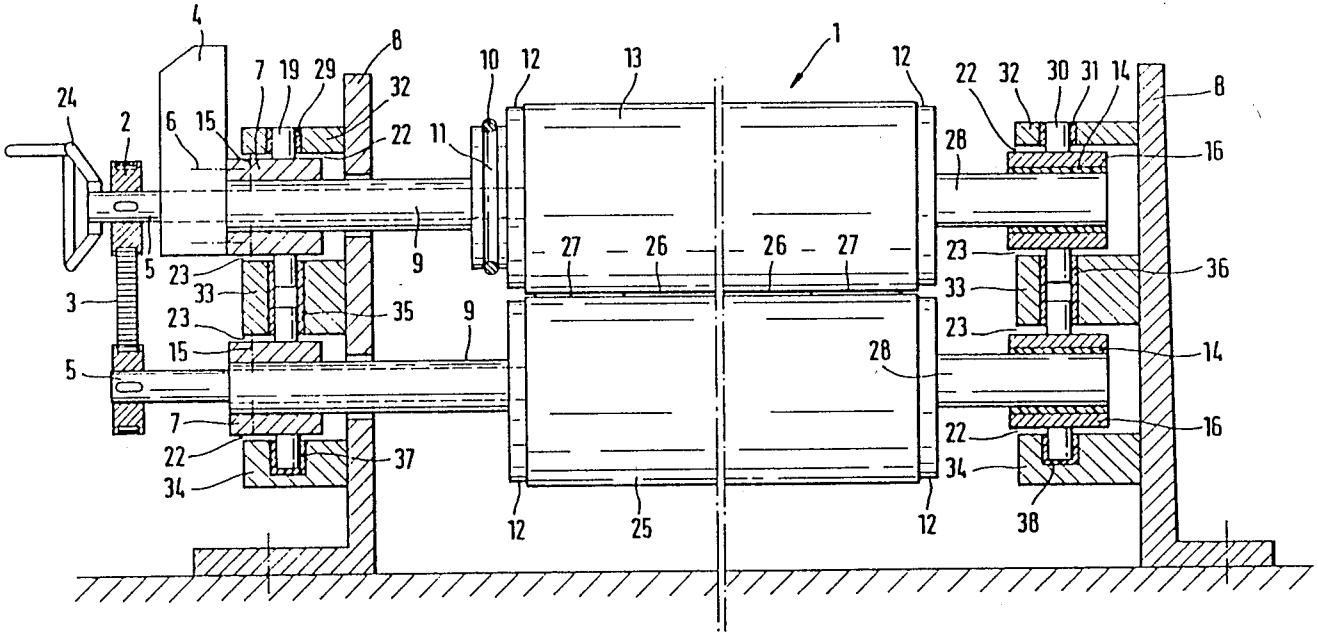
FIG. 1 shows a front view of the apparatus with arched rolls arranged one above the other.

FIG. 1 shows an apparatus 1 for separating adjacent material formats 26, 27 (see also FIG. 3), such as printing plates or printed circuit boards, sheets, film formats or the like. This apparatus 1 includes an upper arched roll 13 which, with a lower arched roll 25, forms a pair of squeeze rolls, through the feed nip of which the material formats 26, 27 run. For example, four material formats or boards can be transported adjacently through the nip and individualized. The arched rolls 13 and 25 are two commercially available arc-adjustable arched spreader rolls. The adjustment crank 24 is connected to a spindle 5, which acts in a way not shown on an arc adjustment mechanism in order to alter the radius of the arched rolls.

The two arched rolls 13 and 25 are arranged one above the other between two upright plates 8, 8, which are of L-shaped design and are fixed by the shorter members on a base plate. The longer member of each of the two upright plates 8, 8 has bearing receptacles 32, 33, 34, which extend at right angles from the longer member of the upright plates 8, 8 and are bolted to these members.

These bearing receptacles are spaced apart and in each case contain sliding bearing bushes 29, 35, 37 and 31, 36, 38, respectively, which are aligned perpendicularly to the axial directions of the arched rolls 13, 25.

The arched roll shaft ends 28, on the right in FIG. 1 are mounted axially freely movably in bearing blocks 16, which in each case have diametrically opposed pintles 30 on two sides, which are received by the previously mentioned sliding bearing bushes 29, 35, 37 and 31, 36, 38, respectively. The bearing blocks 16 are rotatable about the pintles 30 in the sliding bearing bushes. Each of the two blocks 16 includes a sliding bearing bush 14, in which the arched roll shaft ends 28 are mounted. Both the bearing block 16 for the upper arched roll 13 and the bearing block 16 for the lower arched roll 25 have on both sides a clearance 22 and 23, respectively, with respect to the neighboring bearing receptacles 32, 33 and 33, 34 respectively.

The drive of the pair of squeeze rolls 13, 25 takes place by means of a driven, endlessly rotating round belt 10, which is led over a round belt roller 11, which is fixed on the one end face of the arched roll 13.

The left arched roll axis end 9 of each of the two arched rolls 13, 25 is led through the upright plate 8 and is mounted immovably in a bearing block 7. Each of the two bearing blocks 7 is bolted firmly by clamping screws 15 on the arched roll axis end 9 of each arched roll, so that a displacement of the bearing blocks 7 in the axial direction of the arched rolls is not possible. The bearing blocks 7 likewise have on both sides a clearance 22, 23 with respect to the bearing receptacles 32, 33 and 33, 34, respectively. Pintles 19 of the bearing blocks 7, which are likewise mounted diammetrically opposite each other on two sides of the bearing blocks 7, are mounted rotatably in the sliding bearing bushes 29, 35 and 37. The arched rolls 13, 25 are provided with a rubber coating, the two end faces of which are bounded by rubber members 12. On the spindle 5 of the upper arched roll 13 there is located a fixing part 6 for a counter 4. In the case of the present embodiment, the upper arched roll 13 is driven and takes the lower arched roll 25 with it due to the frictional forces. Of course, it is also possible that the lower arched roll 25 alone is driven or that each of the two arched rolls 13, 25 has a drive of its own, which are driven in counter-running directions. It must be borne in mind that the counter-running arched rolls have a transporting effect in the running direction.

On the spindles 5 of the two arched rolls 13, 25 there is located in each case a toothed belt pulley 2, the two toothed belt pulleys 2 being interconnected by an endlessly circulating toothed belt 3. By turning the adjustment crank 24, the movement of the upper spindle 5 is transferred via the toothed belt 3 synchronously onto the lower spindle 5, so that the two arched rolls 13, 25 are arc-adjusted with the same curvature. The counter 4 provides a positional display for the adjustment crank 24 or for the two spindles 5, the counter being designed in such a way that the display is at the same time a measure of the size of the arched roll radii set.

Figure 2:
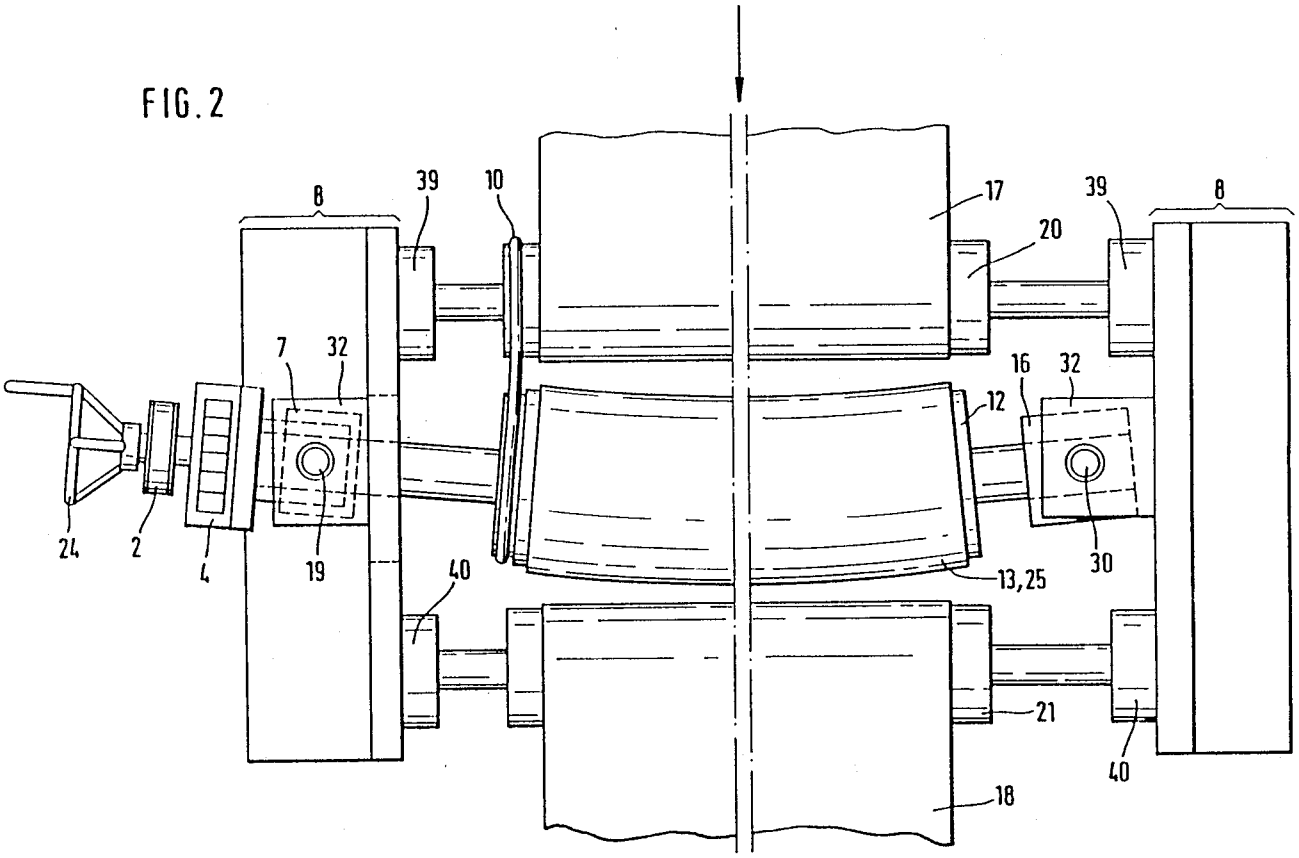
FIG. 2 shows a plan view of the apparatus according to FIG. 1.

In the plan view of the roll frame in FIG. 2, the curvature of the two arched rolls 13, 25 is shown, this curvature being exaggerated in the drawing. On both sides of the roll frame there are transport rolls 20, 21, an incoming transport belt 17 being led over the transport roll 20 and an outgoing transport belt 18 being led over the transport roll 21. The transport belts 17 and 18 move with their upper run on the level of the feed nip of the two arched rolls 13 and 25. The ends of the shaft of the two transport rolls 20, 21 are mounted in bearing blocks 39, 40, which are fixed on the insides of the upright plates 8, 8. Near the left end face of the transport roll 20 there is a round belt pulley with a groove which receives the round belt 10. The round belt is, for example, crossed or placed as a figure-eight loop over this round belt pulley and the round belt roller 11 of the arched roll 13 in a way not shown. As a result, the upper arched roll 13 is driven in the running direction and the lower arched roll 25 is taken along in the opposite direction by friction contact. The transport roll 20 is likewise driven in the running direction. The belt transmission is designed such that the circumferential speed of the arched roll is equal to the transport belt speed. If, for example, the lower arched roll 25 is equipped with a round belt roller and is driven directly in the running direction, the round belt is placed uncrossed over the round belt pulley of the transport roll 20 and over the round belt roller, so that the transport roll 20 is also driven in the running direction.

It can be clearly seen in the plan view of FIG. 2 that the right-hand, rotatable bearing block 16 is pivoted with respect to the bearing receptacle 32, the rotation taking place about the pintle 30. At the same time, the arched roll shaft ends 28 can move freely in the axial direction within the sliding bearing bushes 14.

The left-hand bearing block 7 is fixed on the arched roll shaft end 9, so that it cannot be displaced in the axial direction. Only a rotation of the bearing block 7 about the pintles 19 is possible.

The bearing of the arched rolls 13, 25 ensures that a twisting about the imaginary straight longitudinal axis of the individual arched roll is prevented, the upper arched roll 13 can move freely in the radial direction, in order to allow an adaptation to different material thicknesses of the material formats and that a corresponding length compensation can take place when altering the arc curvature or the arc radius.

Referring to the diagrammatic plan view of the arches rolls 13, 25, it is explained how the individualizing interval 2t relates to the format dimensions l, b and the arched roll radius r of the arched rolls 13, 25. The adjacent material formats 26, 27 have in each case a format width b and a format length l and are transported in running direction A, indicated by an arrow, to the feed nip between the two arched rolls 13, 25. The arched roll radius r extends from the center point of the circle of curvature for the arched rolls up to the dot-dashed center line of the arched rolls. The roll width s of the curved arched rolls 13, 25 corresponds to a secant of the arc with the included angle $\alpha$ over the inner circumferential line of the arched rolls 13, 25, which faces the center point of the curved arched rolls. Due to the curvature of the two arched rolls 13, 25, the initially adjacent material formats 26, 27 are transversely individualized when running through the feed nip between the two arched rolls. The material formats thereby run apart in the direction of the conveying distance resultant.

The respective point of application of the conveying distance resultant is given by the point of intersection of the arched roll center line and the format center line. The direction of the conveying distance resultant is marked by a straight line which, starting from the center point of the circle of curvature of the arched roll, extends through the point of application.

The magnitude of the conveying distance resultant is equal to the magnitude of the vector sum of format length vector $\vec{l}$ and individualizing interval vector $\vec{t}$.

When the entire format length l of the material format 26 has run through the feed nip between the arched rolls 13, 25, the format is displaced on the outgoing transport belt by half the individualizing interval t in the transverse direction and parallel to itself.

Due to the geometrical similarities, the following relationship can be established between the arched roll radius, the format width, the format length and the individualizing interval.

Half the individualizing interval t to format length l=half the format width b/2 to $$\sqrt{r^2 - (b/2)^2}.$$

By appropriate transformation, the following expression is obtained from this relationship:

$$r = b/2\sqrt{(l/t)^2 + 1}$$

where r is the arched roll radius, b is the format width, l is the format length and t is half the individualizing interval. As in general $(l/t)^2$ is very large in relation to 1, the following relationship applies with good approximation for the arched roll radius r:

$$r = \frac{b \cdot l}{2 \cdot t}.$$

It is evident from the two given relationships that, with given format length l and format width b of the material formats 26, 27, the roll radii r of the arched rolls 13, 25 can be adjusted in such a way that a required individualizing interval 2t, transverse to the running direction A of the material formats, can be set between two material formats individualized from each other.

The individualizing interval 2t between two material formats 26, 27 is directly proportional to the product of given format length l and format width b and indirectly proportional to the root of the difference of the squares of the arched roll radius r and half the format width b/2.

For an arched roll radius r which is very large in relation to half the format width b/2, a direct proportionality to the product of format length l and format width b and an indirect proportionality to the arched roll radius r is obtained for the individualizing interval 2t between the two material formats 26, 27.

In the following tables, the arched roll radii r for constant individualizing intervals 2t are compiled for a number of format dimensions, as well as the arc height h, shown in FIG. 3, for different roll widths s. The following relationship applies for the roll width s:

$$s = \frac{r \cdot \pi}{180} \cdot \alpha.$$

Consequentially $$\alpha = \frac{180 \cdot s}{r \cdot \pi}.$$

Figure 3:
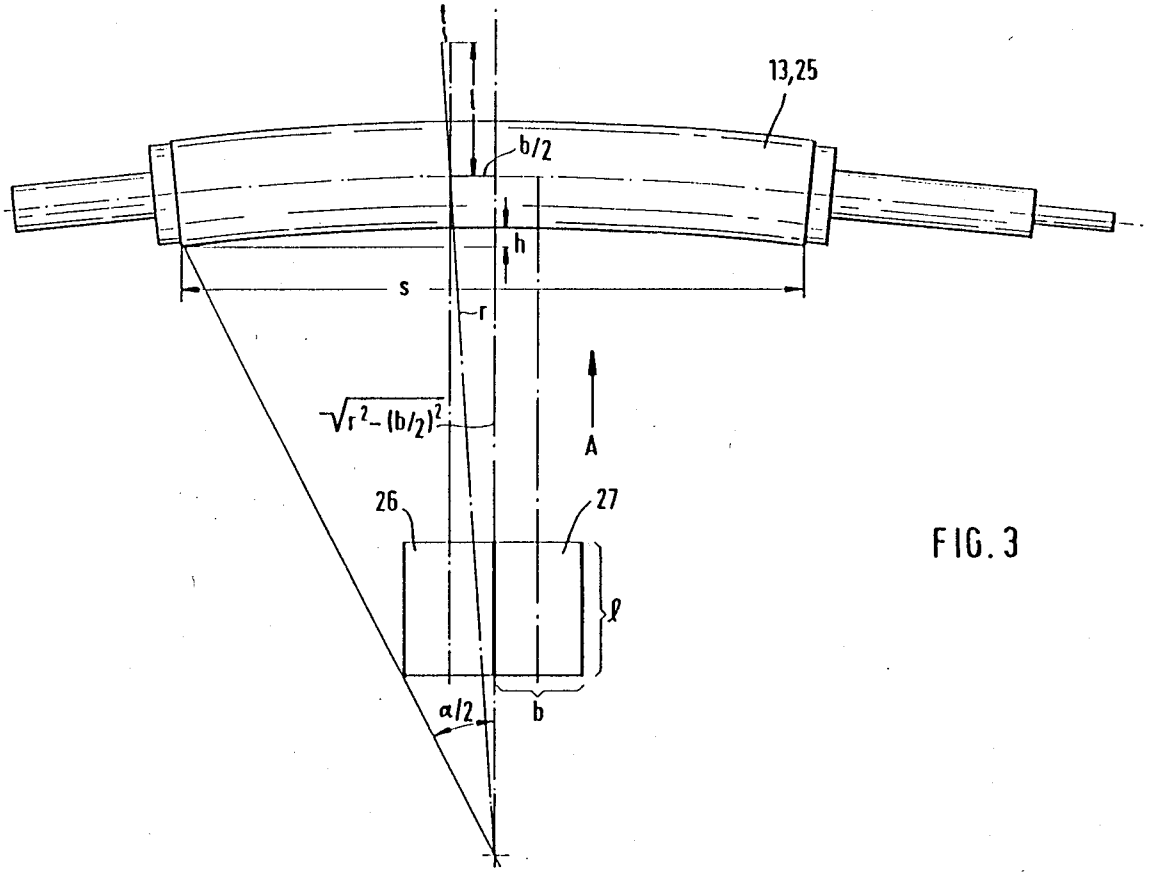
FIG. 3 shows a diagrammatic plan view of an arched roll, with reference to which the interrelationship between the format dimensions of the boards running through, the arched roll radius and the individualizing interval between two adjacent boards is described.

The following trigonometric function is obtained from FIG. 3 for the angle $\alpha$ or $\alpha/2$:

$$\cos \alpha/2 = \frac{r - h}{r}$$

from which it follows that $$h = r(1 - \cos\alpha/2) = r\left(1 - \cos\left(\frac{90 \cdot s}{r\,\pi}\right)\right).$$

The values specified in the tables for the arc height h were calculated according to this relationship with given roll width s and known arched radius r. The other tables give the change in the individualizing interval 2t for constant arched radius r and different format dimensions l and b.

TABLE 1

| Individualizing interval 2t = 10 mm → t = 5 mm | | | | | | |
|---|---|---|---|---|---|---|
| Format l × b (mm × mm) | 450 × 370 | 510 × 415 | 610 × 478 | 745 × 620 | 840 × 665 | 975 × 755 |
| Arched roll radius r(m) | 16.650 | 21.165 | 29.158 | 46.190 | 55.860 | 73.612 |
| Arc height h (mm) with arched roll width s = 500 mm | 16.88 | 13.28 | 9.64 | 6.08 | 5.03 | 3.82 |
| Arc height h (mm) with arched roll width s = 2500 mm | 46.89 | 36.90 | 26.78 | 16.91 | 13.98 | 10.61 |
| Arc height h (mm) = with arched roll width s = 3500 mm | 91.88 | 72.30 | 52.49 | 33.14 | 27.41 | 20.80 |
| Arc height h (mm) with arched roll | 151.79 | 119.48 | 86.76 | 54.78 | 45.30 | 34.38 |

TABLE 1-continued

| Individualizing interval 2t = 10 mm → t = 5 mm |
|---|
| width s = 4500 mm |

TABLE 2

Arc height h as a function of arched roll width s (mm) and arched roll radius r (m)

| | r/m | | | | | | |
|---|---|---|---|---|---|---|---|
| s (mm) | 70 m | 60 m | 50 m | 40 m | 30 m | 20 m | 10 m |
| 1500 | 4.01 | 4.68 | 5.62 | 7.03 | 9.3 | 14.0 | 28.1 |
| 2000 | 7.1 | 8.3 | 9.9 | 12.5 | 16.6 | 24.9 | 49.9 |
| 2500 | 11.1 | 13.0 | 15.6 | 19.5 | 26.0 | 39.0 | 78.0 |
| 3000 | 16.0 | 18.7 | 22.4 | 28.1 | 37.5 | 56.2 | 112.3 |
| 3500 | 21.8 | 25.5 | 30.6 | 38.2 | 51.0 | 76.5 | 152.7 |
| 4000 | 28.56 | 33.3 | 39.9 | 49.9 | 66.6 | 99.4 | 200 |

TABLE 3 individualizing interval 2t for arched roll radius r = 20 m constant, different formats

| Format l × b (mm × mm) | 450 × 370 | 445 × 388 | 520 × 388 | 520 × 394 | 520 × 415 | 1000 × 700 |
|---|---|---|---|---|---|---|
| 2t (mm) | 4.2 | 4.3 | 5.0 | 5.1 | 5.3 | 17.5 |

TABLE 4

Arched roll radius r for individualizing interval 2t = 4 mm constant, different formats

| Format l × b (mm × mm) | 450 × 370 | 445 × 388 | 520 × 388 | 520 × 394 | 510 × 41 | 1000 × 700 |
|---|---|---|---|---|---|---|
| r (m) | 20.813 | 21.583 | 25.220 | 25.610 | 26.457 | 87.501 |

TABLE 5

Arched roll radius r for different individualizing intervals 2t = constant, different formats

| | Format l × b (mm × mm) | | | | | |
|---|---|---|---|---|---|---|
| 2t | 450 × 370 | 445 × 388 | 520 × 388 | 520 × 394 | 510 × 415 | 1000 × 700 |
| 5 mm r (m) | 16.651 | 17.267 | 20.177 | 20.489 | 21.166 | 70.000 |
| 6 mm r (m) | 13.876 | 14.390 | 16.814 | 17.074 | 17.639 | 58.334 |
| 8 mm r (m) | 10.408 | 10.793 | 12.611 | 12.807 | 13.230 | 43.751 |
| 10 mm r (m) | 8.327 | 8.65 | 10.090 | 10.246 | 10.585 | 35.002 |

The arched rolls used are commercially available arc-adjustable arched spreader rolls, with which a format-independent individualizing interval is achieved as a function of the arched radius by suitable bearing, positioning and allowance for the interrelationships between the individualizing interval, the format dimensions and the arched radii of the two arched spreader rolls. The arched radius is representative here of the two same-sized arc radii of the two arched spreader rolls.

While this invention has been illustrated and described in accordance with a preferred embodiment, it is recognized that variations and changes may be made therein without departing from the invention as set forth in the claims.

We claim:

1. Apparatus for separating adjacent material formats comprising:

a pair of arched rolls each having a roll radius and being arranged one above the other as a pair of squeeze rolls having a nip therebetween, the formats running in a running direction through the nip of the rolls; and means for adjusting the radii of the rolls for achieving an interval (2t) between the formats transverse to the running direction of the formats which includes a crank for moving the rolls simultaneously to arc-adjust the rolls with the same curvature.

2. The apparatus of claim 1, wherein the rolls each have first and second opposite ends mounted in first and second bearing receptacles respectively, attached to spaced-apart support plates.

3. The apparatus of claim 2, wherein the bearing receptacles include first sliding bearing bushes therein.

4. The apparatus of claim 3, wherein the first and second ends of the rolls each have diametrically opposed pintles received by the first sliding bearing bushes.

5. The apparatus of claim 4, wherein the first ends of the rolls are fixedly mounted in first bearing blocks.

6. The apparatus of claim 5, wherein the second ends of the rolls are axially movably mounted in second sliding bearing bushes in second bearing blocks.

7. The apparatus of claim 4, wherein the pintles of the first ends of the rolls are mounted rotatably in the first sliding bearing bushes.

8. The apparatus of claim 6, wherein the second bearing blocks are rotatable about the pintles of the second ends of the rolls.

9. The apparatus of claim 6, wherein a clearance is defined between the second bearing blocks and the second bearing receptacles.

10. The apparatus of claim 9, wherein a clearance is defined between the first bearing blocks and the first bearing receptacles.

11. The apparatus of claim 4, wherein the first ends of the rolls are fixedly mounted in the first bearing blocks by means of clamping screws.

12. The apparatus of claim 1, including: counter means for providing a positional display of the crank as a measure of the arched roll radii.

13. The apparatus of claim 1, wherein the interval (2t) between the formats is directly proportional to the product of a given format length (l) and a format width (b) and indirectly proportional to the square root of the difference of the squares of the arched roll radius (r) and half the format width (b/2).

14. The apparatus of claim 1, wherein the interval (2t) between two material formats is directly proportional to the product of given a format length (l) and a format width (b) and indirectly proportional to the arched roll radius (r), for an arched roll radius (r) very large in relation to half the format width (b/2).

15. The apparatus of claim 13, wherein, for the arched roll radius (r) with given format length (l) and format width (b) as well as the given interval (2t), the relationship $$r = b/2 \cdot \sqrt{(l/t)^2 + 1}$$

applies.

* * * * *